US007628374B2

(12) United States Patent
Ly et al.

(10) Patent No.: US 7,628,374 B2
(45) Date of Patent: Dec. 8, 2009

(54) PORTABLE DAVIT MOUNTING BASE

(75) Inventors: Randy Ly, Toronto (CA); Anthony Jin, Toronto (CA)

(73) Assignee: Tractel Ltd., Scarborough, Ontario (CA)

( * ) Notice: Subject to any disclaimer, the term of this patent is extended or adjusted under 35 U.S.C. 154(b) by 0 days.

(21) Appl. No.: 12/071,605

(22) Filed: Feb. 25, 2008

(65) Prior Publication Data

US 2009/0127424 A1 May 21, 2009

(51) Int. Cl.
*F16M 13/00* (2006.01)

(52) U.S. Cl. ..... 248/544; 248/291.2

(58) Field of Classification Search ..... 248/544, 248/219.2, 511, 514, 519, 528, 533, 534; 52/116, 120, 122.1, 125.2, 126.1; 403/322.1, 403/321, 324

See application file for complete search history.

(56) References Cited

U.S. PATENT DOCUMENTS 2,199,897 A * 5/1940 Stringer ..... 52/152
2,985,261 A * 5/1961 Kubesh ..... 52/120
4,545,558 A 10/1985 Crudele
4,557,407 A * 12/1985 Bogaczyk ..... 223/96
4,714,226 A 12/1987 Tracy
4,844,208 A * 7/1989 Veness ..... 182/201
5,509,237 A * 4/1996 Coulter ..... 52/126.6
5,782,446 A 7/1998 Ghahremani
5,862,635 A * 1/1999 Linse et al. ..... 52/126.6
6,347,489 B1 * 2/2002 Marshall et al. ..... 52/169.9
6,536,734 B1 3/2003 Grijmohan et al.
6,631,688 B1 * 10/2003 Maag ..... 112/118

* cited by examiner

*Primary Examiner*—Korie Chan
(74) *Attorney, Agent, or Firm*—Arne I. Fors

(57) ABSTRACT

A portable davit base for removable attachment to a rooftop davit pedestal having a mounting plate includes two opposed side plates and two metal transverse supporting members for mounting on the mounting plate and secured thereto with connector pins that extend underneath edges of the mounting plate on opposite sides of the davit pedestal. The opposed side plates have vertically spaced apertures for inserting davit mast supporting pins for pivotal mounting of a mast on the assembly. A davit arm connected to the mast is rigidly attached to the portable davit mounting assembly for use in suspending scaffolding over the side of a building.

4 Claims, 3 Drawing Sheets

PORTABLE DAVIT MOUNTING BASE

BACKGROUND OF THE INVENTION (i) Field of the Invention

This invention relates to a method and apparatus for mounting davit assemblies on rooftops. More particularly, the invention relates to an improved davit system that is portable and can be installed on an upwardly projecting davit pedestal having a mounting plate.

(ii) Description of the Related Art

Roof top davit systems have long been used by workmen for window washing, painting, maintenance, and the like. It is common practice to provide pairs of davits from which scaffolding can be lowered and raised on the outside of buildings using suspension lines.

U.S. Pat. No. 4,545,558 was granted Oct. 8, 1985 to Richard E. Crudele for a platform suspending davit mounting apparatus and method. The invention includes a mounting socket assembly with wheels and a handle for movement, and a locking clamp to engage a mounting pedestal platform. The mounting socket is adapted to receive a davit.

U.S. Pat. No. 5,782,446 granted to Ali Ghahremani Jul. 21, 1998 describes a davit mounting assembly mounted on a generally circular mounting plate for positioning of the davit mounting assembly at any rotational angle to accommodate particular building contours or features.

U.S. Pat. No. 6,536,734 was granted to Lakhram Brijmohan and Roman Gargulak on Mar. 25, 2003 for a portable davit mounting assembly. The invention describes a portable davit base adapter having interlocking feet that are received by mounting plate apertures.

U.S. Pat. No. 4,714,226 was granted on Dec. 22, 1987 to Stephen E. Tracy for a method and apparatus for mounting a davit on a roof structure. The invention includes a socket having hooks that are inserted and locked into openings in the top of a base member. The base member does not have a pedestal and is substantially flush with a rooftop.

SUMMARY OF THE INVENTION

An object of the present invention is to provide for an improved portable davit mounting assembly and method for removable attachment of a davit base to a rooftop pedestal and mounting plate. The davit mounting assembly has a simple design with few parts. The portable davit base is lightweight and comes with a handgrip, so that one person can carry it. The portable davit base can be set on top of the mounting plate, or can be slid on from either end of the plate.

The present invention provides a portable davit base for attachment to a mounting plate forming part of a davit pedestal, the mounting plate having a pair of projecting opposite side edges. The mounting plate can be rectangular.

The davit base has a pair of spaced-apart opposed side plates joined together by a pair of transverse support members fixedly attached to the side plates such as by welding and is adapted for mounting on the pedestal mounting plate with the two transverse support members positioned above and resting on the mounting plate side edges. The opposed side plates include downwardly extending lobe portions overlapping the mounting plate side edges and extending further downwards.

Each of the opposed side plate downwardly extending lobes has a front securing pin aperture and a rear securing pin aperture that are concentrically aligned with the corresponding apertures formed on the lobes of the opposed plate, to form two pairs of securing pin apertures, a front pair and a rear pair. Each pair of securing pin apertures is aligned to receive a securing pin located proximal to the bottom edges of the opposed side plates downwardly extending lobe portions below the mounting plate side edges.

The front pair and the rear pair of securing pin apertures are positioned on opposite sides of the davit pedestal below the transverse support members, such that when a pair of securing pins are received by the mounted davit base, both securing pins will be positioned below the mounting plate with one securing pin in front of the davit pedestal and the other behind. This will block removal of the mounted davit base assembly from the mounting plate.

Each of the two opposed side plates has upper and lower pivot pin apertures that are concentrically aligned with the corresponding apertures of the opposed plate to form two pairs of pivot pin apertures. Each pair is aligned to receive a davit pivot pin. A davit mast with a bottom end sized to fit into the space between the opposed side plates and with two davit mast pivot pin apertures concentric with and internal to the two pairs of davit base pivot pin apertures can be engaged by a davit pivot pin inserted for pivotal attachment in the lower pivot pin apertures. The davit mast can then be pivotally raised to a vertical position aligning all unsecured pivot pin apertures such as to allow the insertion of a second davit pivot pin, thusly attaching the davit mast to the portable davit base assembly.

In its broad aspect, the portable davit base of the invention for removable attachment of a davit mast to a mounting plate of a davit pedestal, said mounting plate having a pair of opposite side edges, comprises a pair of spaced-apart opposed side plates joined together by a pair of laterally-spaced transverse support members fixedly attached to said side plates defining a space to receive the davit mast, said opposed side plates having a pair of securing pin apertures aligned with each other to receive a securing pivot pin below each transverse support member for straddling the davit pedestal mounting plate and for gripping the mounting plate side edges therebetween; said two opposed side plates having concentrically aligned upper and lower pairs of pivot pin apertures, each pair aligned to receive a davit mast pivot pin, such that a davit mast with a bottom end sized to fit into the space in between said opposed side plates and having two davit mast pin apertures formed to fit concentric with and internal to said two pairs of base adapter pivot pin apertures can be pivotally connected to the lower mast pivot pin apertures by a davit pivot pin inserted for pivotal attachment, whereby said davit mast can be pivotally raised to a vertical position aligning the upper mast pivot pin apertures such as to allow the insertion of a second davit pivot pin, thereby attaching the davit mast to said portable davit base.

According to one aspect of the invention, the two pairs of base adapter pivot pin apertures are positioned vertically relative to each other. It is also possible that the davit mast pivot pin apertures, the base adapter pivot pin apertures and the securing pin apertures are all round and all have the same diameter.

Another aspect of the davit mounting base includes each opposed side plate having a safety line aperture located outwardly extended from the two pairs of base pivot pin apertures. This is to prevent tangling of a safety line with the davit mast and the davit mounting assembly.

In a further aspect of the invention that the davit base comprises a transverse handgrip member joining the pair of opposed side plates with the handgrip member proximal to an edge of each opposed side plate above the centre of gravity of the portable davit base.

Another aspect of the invention includes the transverse support members being fixed to the opposed side plates by means of welding.

BRIEF DESCRIPTION OF THE DRAWINGS

A preferred embodiment of the invention will now be described with reference to the accompanying drawings in which.

DESCRIPTION OF THE PREFERRED EMBODIMENTS

Figure 1:
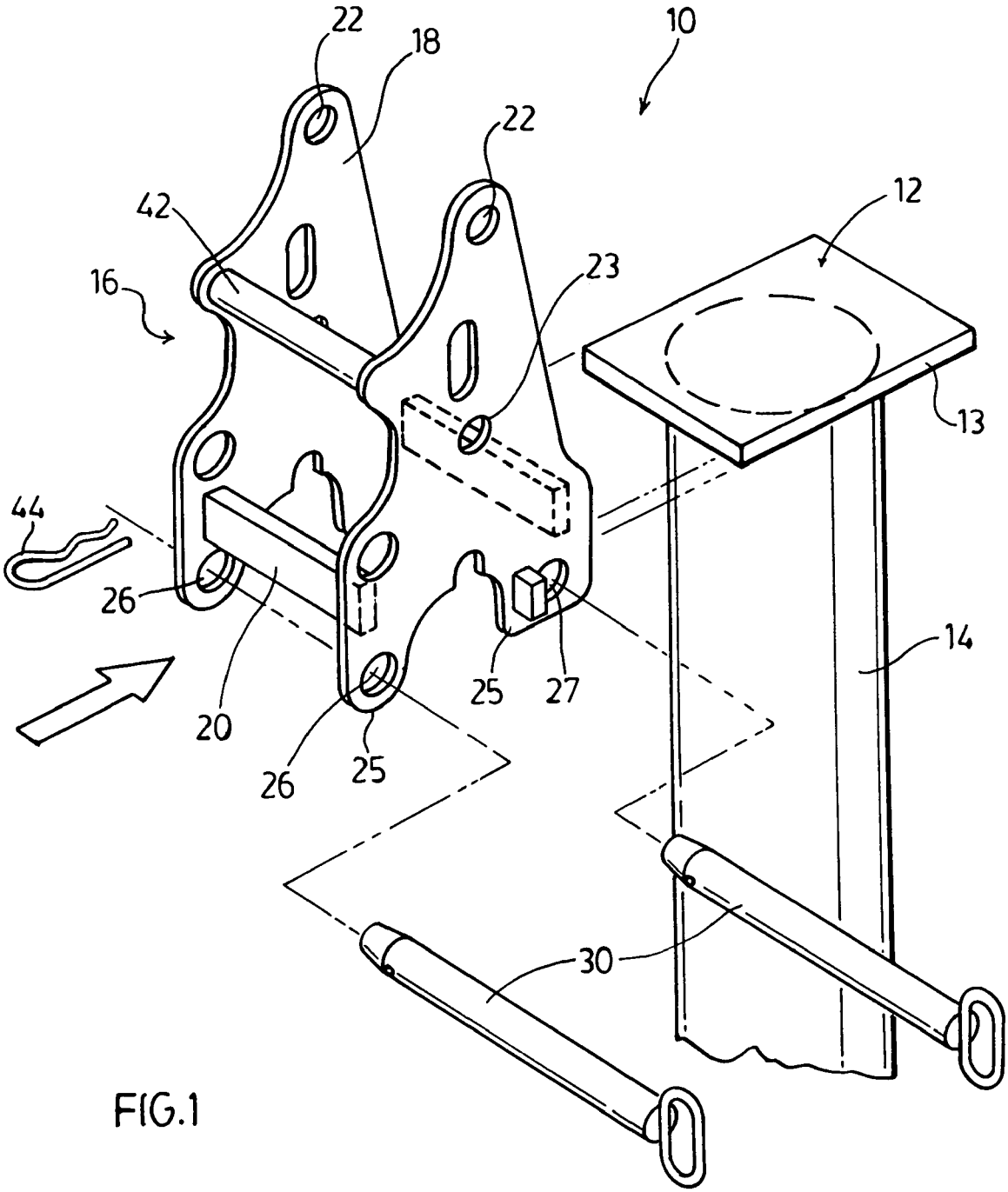
FIG. 1 is a perspective view of the portable davit base separated laterally from the mounting plate.
Figure 2:
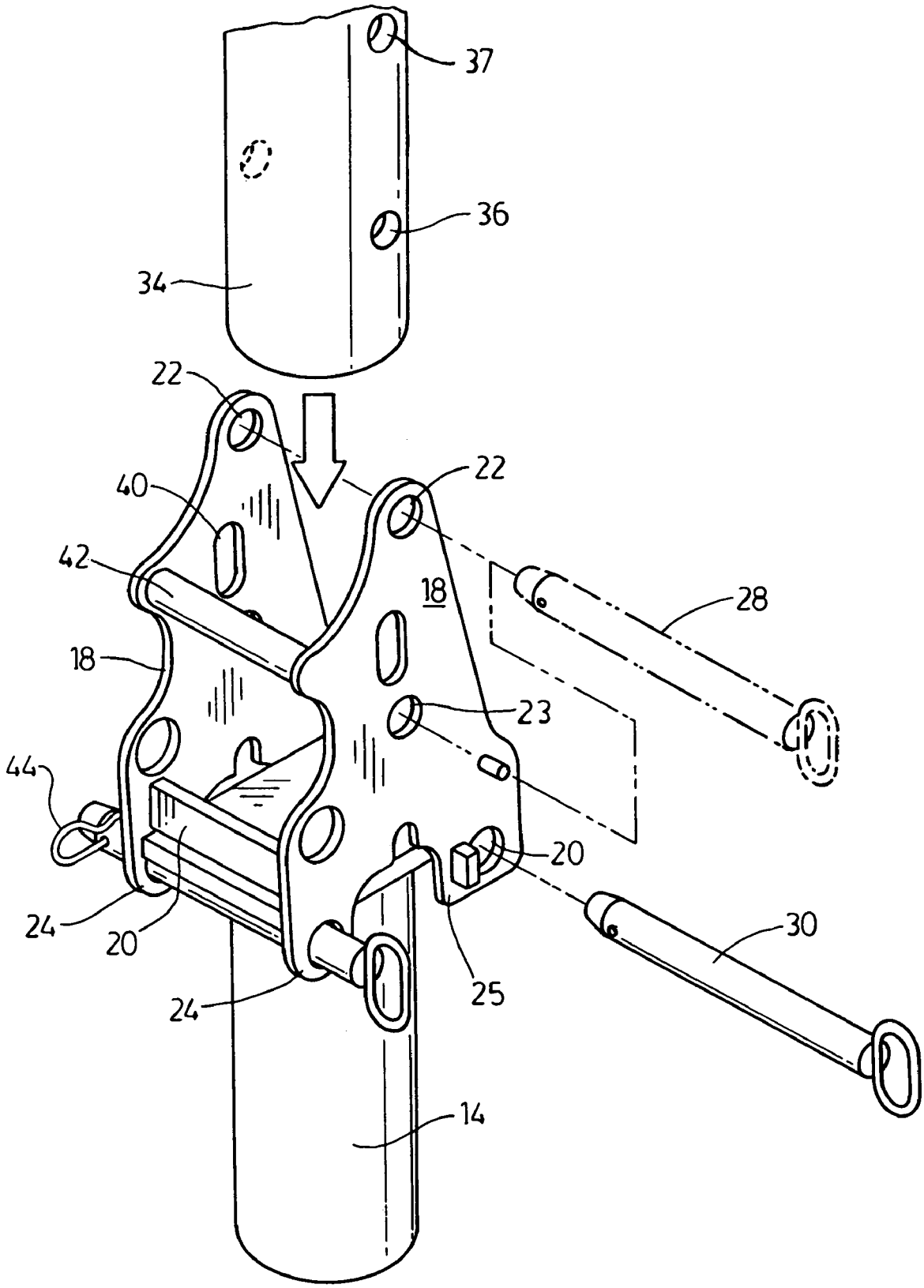
FIG. 2 is a perspective view of the portable davit base placed on top of the mounting plate.

With reference to FIGS. 1 and 2, the davit mounting assembly 10 of the invention is for attachment to mounting plate 12 of upright tubular davit pedestal 14. Mounting plate 12 is fixedly attached to the top of davit pedestal 14, by means such as welding. Davit pedestal 14 is embedded in and permanently secured to a roof, not shown. Mounting plate 12 is most likely rectangular as is common in the prior art, but could possibly be other shapes.

Portable davit base 16 has a pair of parallel spaced-apart opposed side plates 18 joined together by two transverse support members 20 fixedly attached to the side plates 18 by means such as welding. The pair of opposed side plates 18 are also joined by transverse handgrip member 42 proximal to upper side edges of the opposed side plates 18. The handgrip member 42 preferably is above the portable davit centre of gravity and is readily useable for lifting the portable davit base 16. The davit base 16 can be set on top of mounting plate 12 from above, or slid on from either end of the mounting plate. A mounted davit base 16 as shown most clearly in FIG. 3 has the two transverse support members 20 positioned above mounting plate 12 resting on the top surface of mounting plate 12 at each end thereof on side edges 13.

The opposed side plates 18 include downwardly extending lobes 24, 25 overlapping the mounting plate side edges 13 and extending further downwards to accommodate front securing pin apertures 26 and rear securing pin apertures 27 respectively. Apertures of the one plate are concentrically aligned with the corresponding apertures of the opposed plate, to form two pairs of securing pin apertures, a front pair and a rear pair. Each pair of securing pin apertures 26, 27 is aligned to receive a securing pin 30. The two pairs of securing pin apertures 26, 27 are located proximal to the bottom edges of the opposed side plates downwardly extending lobes 24. When davit base 16 is in the mounted position, each pair of securing pin apertures 26, 27 will have an axis of alignment below mounting plate 12. Front pair of securing pin apertures 26 is positioned in front of davit pedestal 14 and rear pair 27 is positioned in back of davit pedestal 14. When a pair of securing pins 30 is received by the mounted davit base adapter 16, both securing pins will be positioned below the mounting plate 12 with one received securing pin 30 in front of the davit pedestal 14 and the other behind. Clips 44 are inserted in securing pins 30 to retain the pins. Securing pins 30 block removal of the mounted davit base adapter 16 from mounting plate 12 and secure davit base adapter 16 thereto. In the preferred embodiment as illustrated most clearly by FIG. 4, the two securing pins 30 hold davit base 16 firmly in place.

Figure 3:
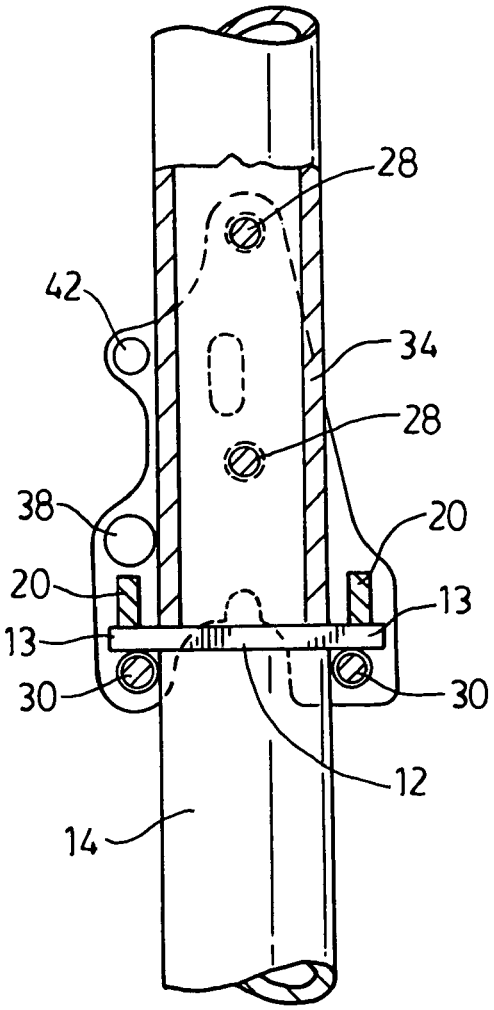
FIG. 3 is a partially cut away side view of the davit base installed on the mounting plate and with a received davit mast secured in place.
Figure 4:
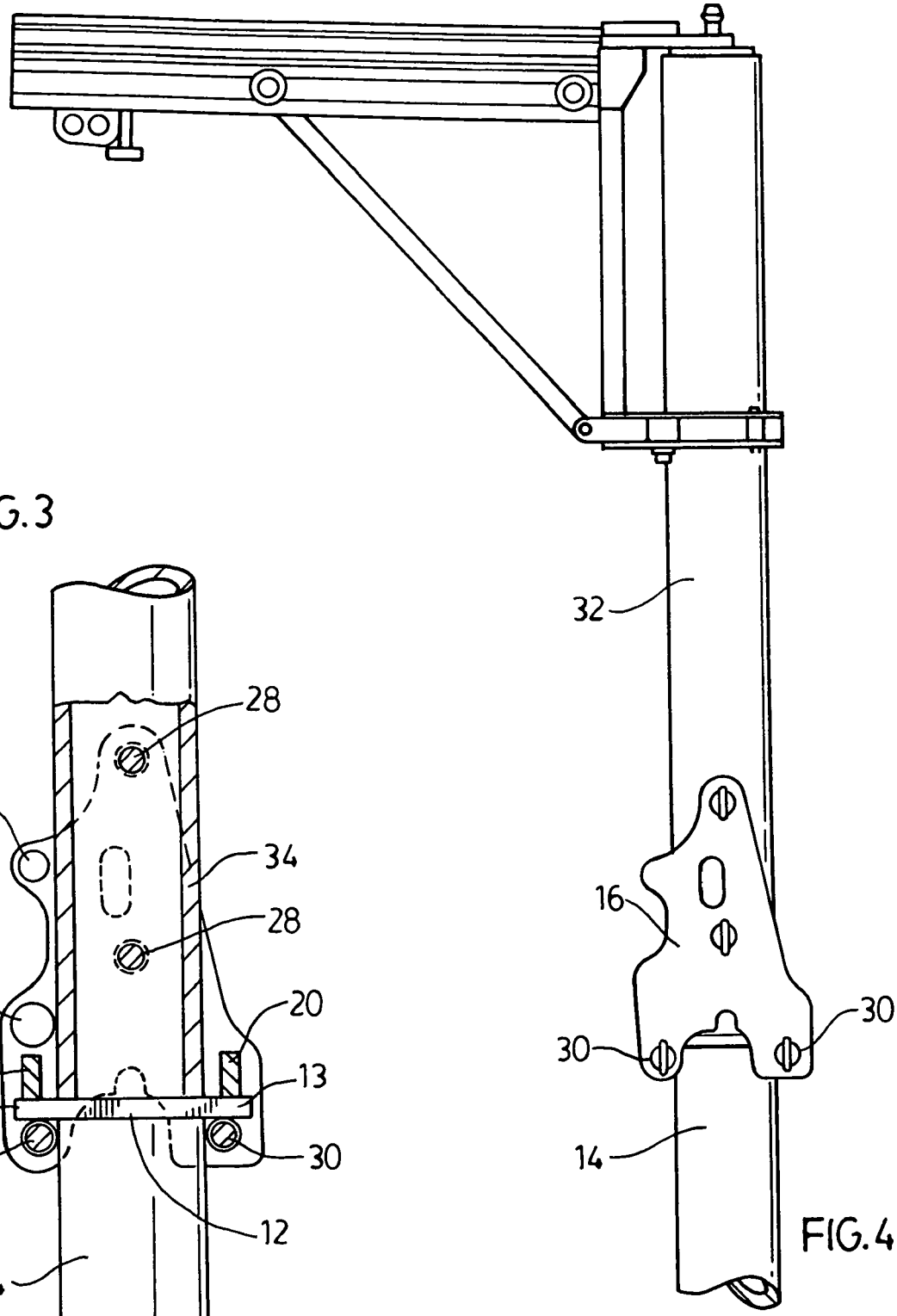
FIG. 4 is a side elevational view of the davit assembly including an installed davit mast.

Again making reference to FIGS. 1 and 2, each of the two opposed side plates 18 has vertically-spaced upper and lower davit base pivot pin apertures 22, 23 that are concentrically aligned with the corresponding apertures of the opposed plate to form two pairs of davit base pivot pin apertures. Each pair is aligned to receive a davit pivot pin 28. A davit mast 32 with a bottom end 34 sized to fit into the space between the opposed side plates 18 has two davit mast pivot pin apertures 36, 37 formed to fit concentric and internal to the two pairs of base adapter pivot pin apertures 22, 23. Apertures 36 are first engaged to receive a first davit mast pivot pin 28 inserted for pivotal attachment. The davit mast 32 can then be pivotally raised to a vertical position, bottom end 34 being spaced from mounting plate 12 to permit pivotal clearance, aligning upper mast aperture 37 with plate apertures 22 such as to allow the insertion of a second davit pivot pin 28, to result in installed davit mast 32 as shown in FIGS. 3 and 4. Clips 44 are inserted to retain davit pivot pins 28.

In the preferred embodiment of the invention, the two pairs of davit base pivot pin apertures 22, 23 are positioned vertically relative to each other, but other configurations are possible, such as when davit mast bottom end 34 is square shaped rather than round. It is also preferred that the davit mast pivot pin apertures 36, 37 the base adapter pivot pin apertures 22, 23 and the securing pin apertures 26, 27 have the same diameter, allowing the use of interchangeable pins, as is shown in FIG. 2.

Referring to FIG. 3, davit base 10 preferably includes each opposed side plate 18 having a safety line aperture 38 located outwardly from pivot pin apertures 22 to prevent tangling of a safety line (not shown) with davit mast 32 and davit base 10.

The invention provides for an improved portable davit base and method for removably attaching it to a rooftop pedestal and mounting plate. The davit mounting assembly has a simple design with few parts. While a preferred embodiment of the invention has been described herein, it will be understood that other embodiments and examples of the invention will be readily apparent to a person skilled in the art, the scope and purview of the invention being defined in the appended claims.

The invention claimed is:

1. A portable davit base for removable attachment of a davit mast to a mounting plate of a davit pedestal, said mounting plate having a pair of opposite side edges comprising:

a pair of spaced-apart opposed side plates joined together by a pair of laterally-spaced transverse support members fixedly attached to said side plates in a lower portion of each of said side plates defining a space to receive the davit mast, said opposed side plates having a pair of securing pin apertures aligned with each other to receive a securing pin below each transverse support member for straddling the davit pedestal mounting plate and for gripping the mounting plate side edges therebetween;

said two opposed side plates having concentrically aligned upper and lower pairs of base adaptor pivot pin apertures, each pair of said base adaptor pivot pin apertures aligned to receive a first davit mast pivot pin and a second davit mast pivot pin respectively, such that said davit mast with a bottom end sized to fit into the space in between said opposed side plates, and said davit mast having two upper and lower davit mast pin apertures formed to aligned with and internal to said upper and lower pairs of base adapter pivot pin apertures respectively such that said davit mast can be pivotally connected to the lower davit mast pin apertures by the first davit mast pivot pin inserted therein for pivotal attachment, whereby said davit mast can be pivotally raised to a vertical position aligning the upper davit mast pin apertures such as to allow the insertion of the second davit mast pivot pin, thereby locking the davit mast in an upright vertical position and attaching the davit mast to said portable davit base.

2. The portable davit base according to claim 1 wherein said two pairs of base adaptor pivot pin apertures are positioned vertically relative to each other.

3. The portable davit base according to claim 2 further comprising said pair of opposed side plates being joined by a transverse handgrip member, said handgrip member joined proximal to an edge of each said opposed side plates such that said handgrip member is above a portable davit base centre of gravity and readily useable for lifting said portable davit base.

4. The portable davit base according to claim 2, wherein each of the side plates has a pair of laterally spaced downwardly projecting lobes formed in the lower portion thereof in which the aligned securing pin apertures are formed.

* * * * *